United States Patent [19]

Seifert

[11] Patent Number: 4,898,058

[45] Date of Patent: Feb. 6, 1990

[54] APPARATUS FOR REMOVING PELLICLES

[75] Inventor: Willis Seifert, Cupertino, Calif.

[73] Assignee: Intel Corporation, Santa Clara, Calif.

[21] Appl. No.: 137,881

[22] Filed: Dec. 24, 1987

[51] Int. Cl.[4] ..... B26D 3/28

[52] U.S. Cl. ..... 83/870; 83/697; 83/468.4; 156/584

[58] Field of Search ..... 83/870, 467 R, 697; 156/584, 344; 69/15, 16, 9

[56] References Cited

U.S. PATENT DOCUMENTS

| | | | |
|---|---|---|---|
| 24,265 | 5/1859 | Messer | 69/16 |
| 518,774 | 4/1894 | Bayley | 69/176 |
| 534,746 | 2/1895 | Jarves | 83/870 |
| 820,975 | 5/1906 | Holmes et al. | 69/15 |
| 1,906,358 | 5/1933 | Bedell | 69/15 |
| 2,685,901 | 8/1954 | Putzer | 83/870 |
| 2,821,254 | 1/1958 | Kerner | 83/870 |
| 3,340,916 | 9/1967 | Burch | 83/870 |
| 3,689,396 | 9/1972 | Casagrande et al. | 156/584 |
| 4,255,216 | 3/1981 | Conant et al. | 156/584 |
| 4,466,852 | 8/1984 | Beltz et al. | 156/584 |

*Primary Examiner*—Frank T. Yost
*Assistant Examiner*—Scott A. Smith
*Attorney, Agent, or Firm*—Blakely, Sokoloff, Taylor & Zafman

[57] ABSTRACT

An apparatus for removing a pellicle that is adhesively bonded to a photomask. A first embodiment of the invention is provided for removing a pellicle having a generally rectangular shape. The photomask is placed in a housing with the pellicle facing down. A pair of blades are mounted on a carriage that are longitudinally movable within the housing. The blades are adjustable such that the cutting edges are immediately below the surface of the photomask. The carriage is driven by a rack and pinion assembly causing the blades to cut through the adhesive layer bonding the pellicle to the photomask. A second embodiment of the invention is provided for removing a pellicle having a generally circular shape. In this embodiment, the blades are mounted on a rotating bar. Rotation of the bar causes the blades to cut through the adhesive layer bonding the pellicle to the photomask.

9 Claims, 3 Drawing Sheets

APPARATUS FOR REMOVING PELLICLES

FIELD OF THE INVENTION

This invention relates to semiconductor fabrication equipment, and particularly to an apparatus for removing adhesively bonded pellicles from photomasks.

BACKGROUND

One method for processing semiconductor wafers to produce integrated circuits involves the use of 1:1 photolithography, wherein a photomask is used which has a full size image of the pattern to be transferred to the wafer. Exposure may be accomplished in a step and repeat process in which the photographic image is sequentially exposed on each of the individual cells of the wafer. It is conventional to refer to a photomask used in a step and repeat process as a "reticle".

Alternatively, the entire surface of a wafer may be exposed using a photomask with a full wafer image.

Both types of photomasks generally comprise a plate of quartz or low expansion glass with a thin layer of chromium deposited on one surface into which the image is etched. Regardless of the type of photomask used, cleanliness of the mask is critical to producing a wafer in which defects are minimized. Particulate matter on the etched surface of the photomask or anywhere within the focal length of the exposure lens will likely produce a defect in the processed wafer. To minimize such defects, it is common to cover the image area of the photomask with a dust cover. Such covers typically consist of a frame of aluminum or other suitable material having a thin transparent membrane of nitrocellulose or a similar material. The thickness of the frame is such that the dust cover will preclude particulate matter within the focal length of the exposure lens. Frames are typically approximately 0.050 inches thick. Such a dust cover is commonly referred to as a "pellicle". Pellicles are typically attached to a photomask with an adhesive coated vinyl tape having a thickness of 5 mils or greater.

Pellicles need to be applied only to the etched surface of the photomask since the thickness of the glass substrate precludes airborne particulates from coming within the focal length of the lens on the side of the photomask opposite the etched lamp.

Since the delicate membrane of a pellicle is easily damaged, it is frequently necessary to remove a pellicle from a photomask in order to apply a new pellicle. Mechanical removal by prying off the pellicle is frequently unsuccessful since the photomask is easily damaged.

A more common technique for pellicle removal is to place the photomask in an acetone bath to at least partially dissolve the adhesive. This technique may require from four hours to four days to detach a pellicle. Such a lengthy process cannot be tolerated if a production line is stopped awaiting rework of a photomask. Furthermore, this pellicle removal technique suffers the inherent disadvantage of using a hazardous solvent.

As will be subsequently described, the present invention provides a controlled mechanical means of removing a pellicle. Accurately positioned cutting blades are inserted between the photomask and the pellicle such that the pellicle may be removed from the photomask very quickly, without the use of hazardous chemicals and with minimal risk of damage to the photomask.

SUMMARY OF THE INVENTION

The present invention provides an apparatus for mechanically removing a pellicle from a photomask using accurately positioned cutting blades.

In one embodiment of the invention, a pair of cutting blades is attached to a carriage which moves longitudinally within a housing. A photomask having a generally rectangular pellicle is inserted in a well in the housing with the pellicle facing down. A rack and pinion drive mechanism causes the carriage to move linearly in response to rotation of an operator's handle. The blades are accurately positioned in a vertical position such that the cutting edges of the blades intercept the adhesive layer between the photomask and the pellicle. By driving the blades along the entire length of the pellicle frame, the pellicle is readily detached from the photomask.

An alternative embodiment of the present invention is provided for detaching pellicles having a generally circular shape. A pair of blades is mounted on opposite ends of a rotating bar that is attached to a shaft and driven by a bevel gear arrangement. The blades are similarly adjustable in a vertical dimension such that the cutting edges of the blades intercept the adhesive layer joining the pellicle to the photomask. Rotation of the bar drives the blades around the perimeter of the pellicle frame, thereby detaching it from the photomask.

DETAILED DESCRIPTION OF THE PREFERRED EMBODIMENTS

Figure 1:
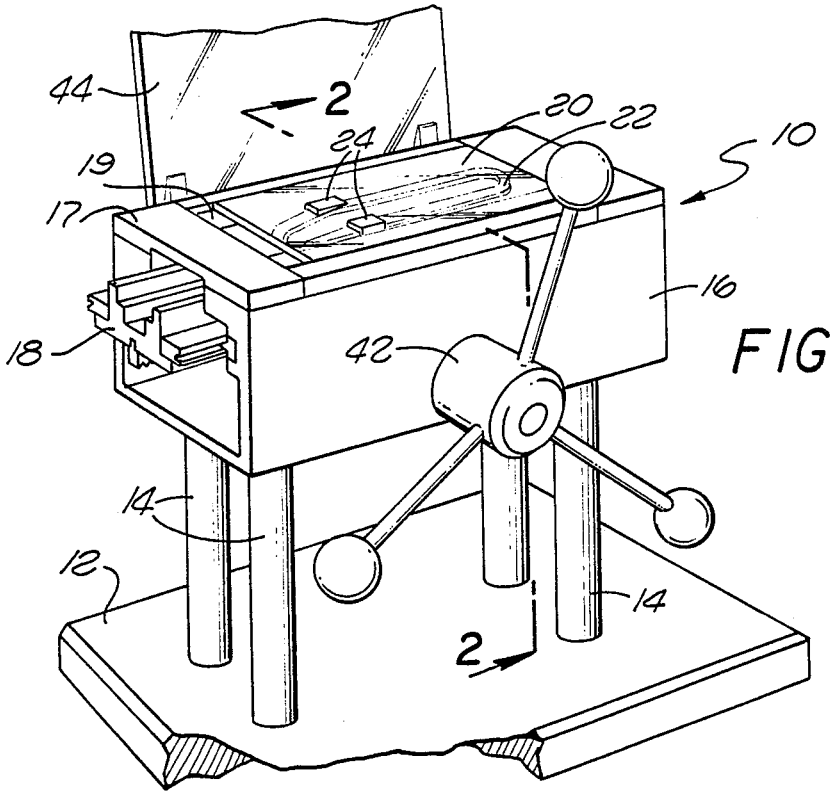
FIG. 1 is a perspective view of an embodiment of the present invention for removing rectangular pellicles.
Figure 2:
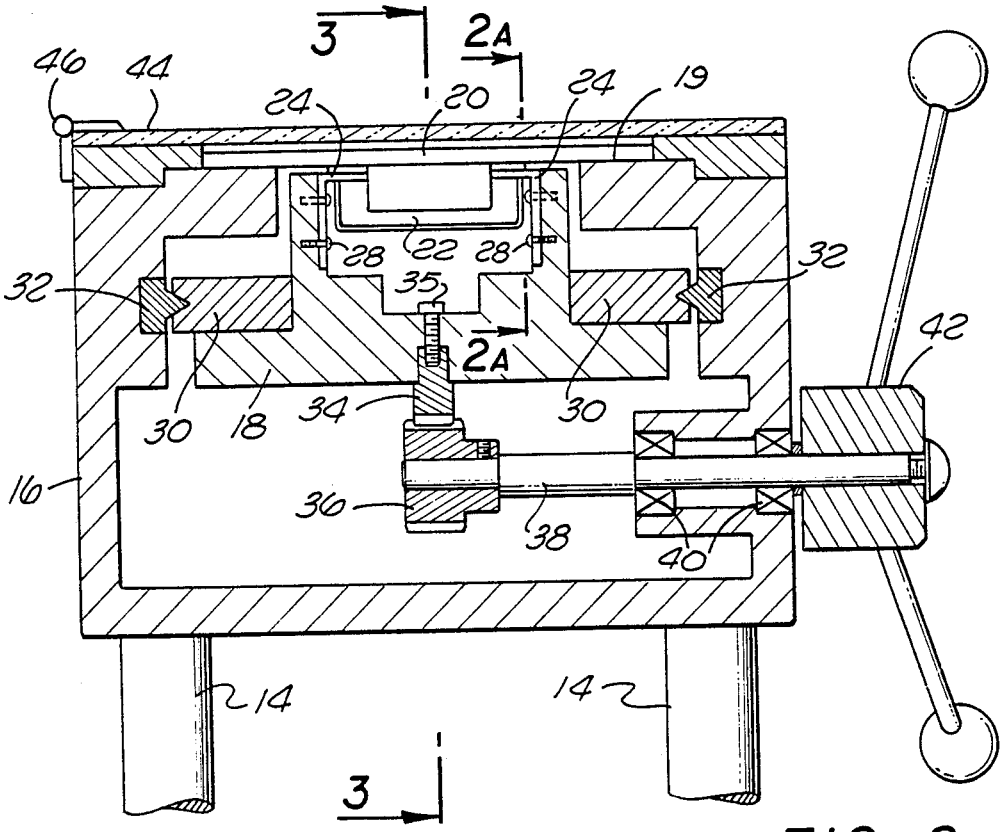
FIG. 2 is a cross-sectional view taken through line 2—2 of FIG. 1.

An apparatus for removing pellicles is disclosed. In the following description, for purposes of explanation and not limitation, specific numbers, dimensions, materials, etc. are set forth in order to provide a thorough understanding of the present invention. However, it will be apparent to one skilled in the art that the present invention may be practiced without these specific details.

FIGS. 1–4 illustrate an apparatus 10 for removing a pellicle from a standard 1:1, 3×5 inch photomask such as reticle 20. Base 12 supports legs 14 on which is mounted housing 16. Housing 16 is generally in the shape of a rectangular box open at each end. Carriage 18 is longitudinally slidable within housing 16.

A shallow well is formed at the top of housing 16 for receipt of reticle 20 on surface 19. Reticle 20 is inserted in housing 16 with pellicle 22 facing down. Surface 19 is sufficiently below top surface 17 of housing 16 that reticle 20, which is typically approximately 0.090 inches thick, lies entirely below surface 17.

As will be subsequently described, pellicle 22 is removed from reticle 20 by blades 24. Blades 24 are attached to carriage 18 by means such as screws 28. Blades 24 includes elongated mounting holes 26 by which the vertical position of blades 24 with respect to carriage 18, and thus with respect to surface 19, may be adjusted. Blades 24 are generally "L" shaped and are ground to form knife edge 25.

Longitudinal slides 30 are mounted on each side of carriage 18. Slides 30 ride on tracks 32 which are mounted to housing 16. Slides 30 and tracks 32 allow carriage 18 to slide longitudinally within housing 16, but prevent vertical displacement of carriage 18. Rack 34 is mounted to the underside of carriage 18 by means such as screws 35. Rack 34 mates with pinion gear 36 which is mounted to axle 38. Axle 38 rides within bearings 40 located, such as by a press fit, within housing 16. Handle 42 is attached to axle 38 external to housing 16 for manual rotation of axle 38. As is apparent, rotation of handle 42 will translate into linear motion of carriage 18.

Safety cover 44 is attached to housing 16 by means of hinge 46. Safety cover 44 serves to protect an operator in the event that reticle 20 shatters during the pellicle removal process.

Figure 3:
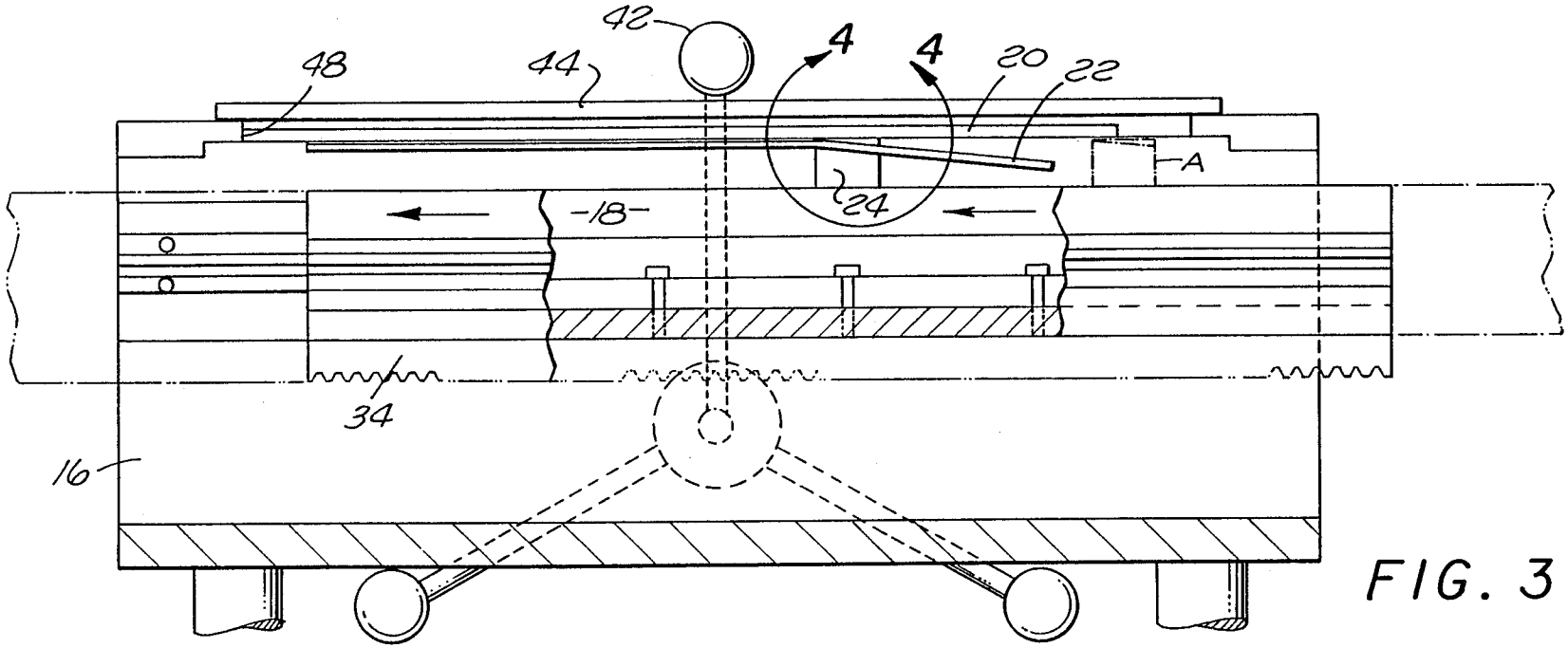
FIG. 3 is a cross-sectional view taken through line 3—3 of FIG. 2.
Figure 4:
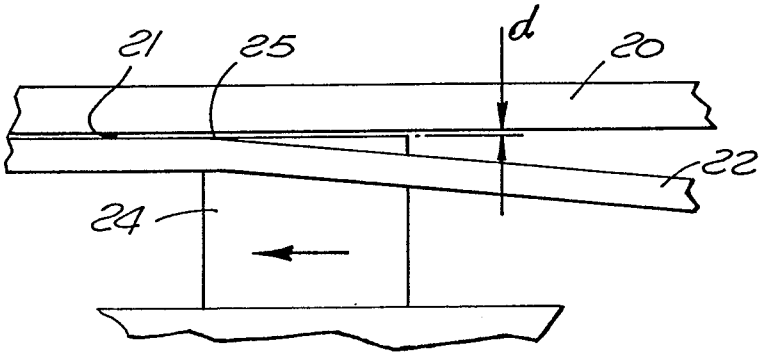
FIG. 4 is a detailed cross-sectional view illustrating the removal of a pellicle from a reticle.
Figure 2A:
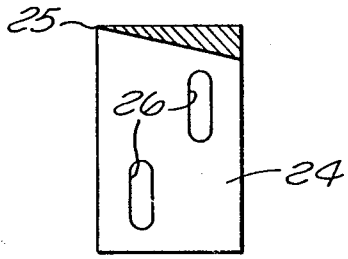
FIG. 2A is a detailed view of a cutting blade of the present invention.

Referring primarily to FIGS. 3 and 4, the removal of pellicle 22 from reticle 20 will now be described. Handle 42 is first rotated clockwise as viewed in FIG. 3 to position carriage 18 to the right such that blade 24 is in position A (shown in phantom). As previously mentioned, reticle 20 is placed on surface 19 of housing 16 with reticle 22 on the underside of reticle 20. Safety cover 44 is then closed against the upper surface of housing 16. Handle 42 is then rotated in a counterclockwise direction as shown by the arrows in FIG. 3 causing carriage 18 to move to the left.

As carriage 18 moves to the left, knife edge 25 of blade 24 intercepts adhesive layer 21 that bonds pellicle 22 to reticle 20. Adhesive layer 21 is typically approximately 0.005 inches in thickness. As previously discussed, blade 24 is adjustable vertically. When blades 24 are installed on carriage 18, they are adjusted such that the clearance between knife edge 25 and surface 19 of housing 16 is in the range of approximately 0.002–0.004 inches. This insures that knife edge 25 will intercept adhesive layer 21 rather than pellicle 22 itself. Continued rotation of handle 42 in a counterclockwise direction causes carriage 18 and blades 24 to continue to move to the left as shown in FIGS. 3 and 4. This causes reticle 22 to separate from reticle 20 as illustrated in FIG. 4. Longitudinal displacement of reticle 20 due to the force applied by blade 24 is prevented by contact with wall 48 of housing 16. Rotation of handle 42 is continued until pellicle 22 is completely separated from reticle 20.

After separation of pellicle 22, safety cover 44 is raised, and reticle 20 is removed from well 19. Any residue of adhesive layer 21 remaining on reticle 20 may be removed with a solvent such as MEK or acetone, or in an acid bath.

Figure 5:
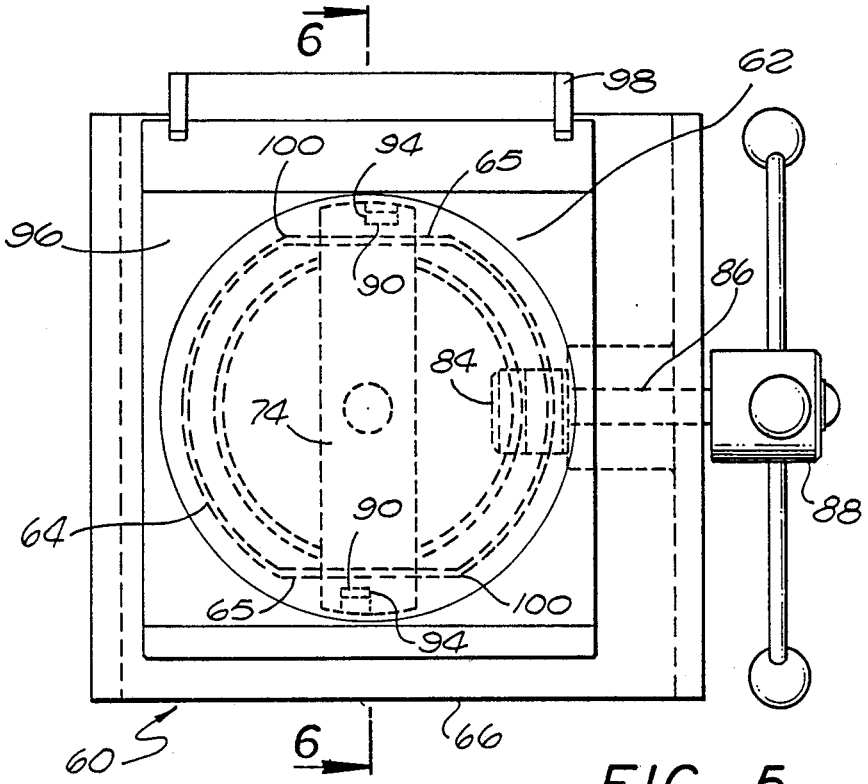
FIG. 5 is a plan view of an alternative embodiment of the present invention for removing circular pellicles.
Figure 6:
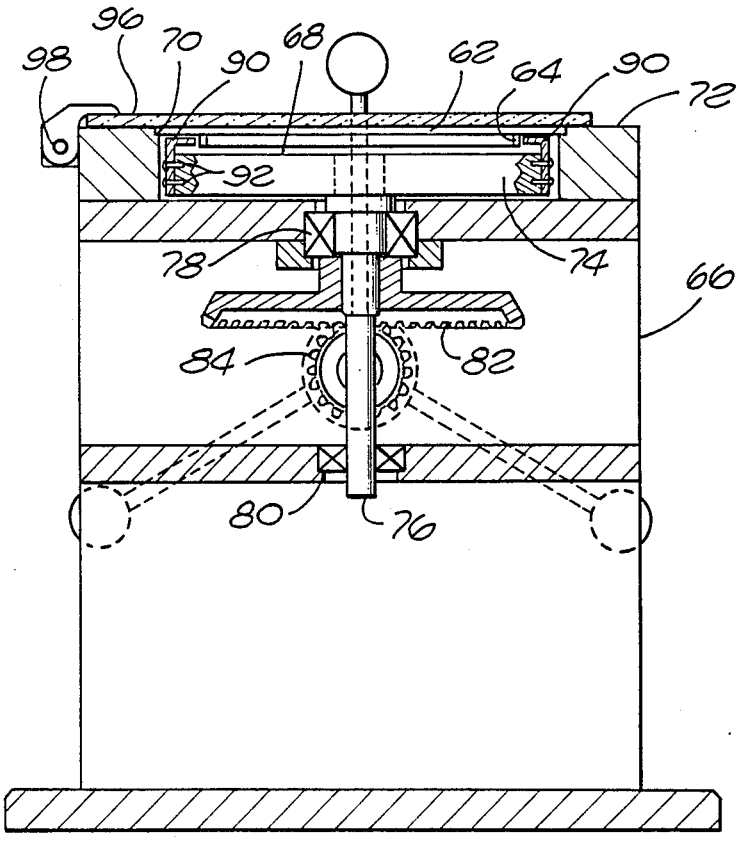
FIG. 6 is a cross-sectional view taken through line 6—6 of FIG. 5.

FIGS. 5–6 illustrate an alternative embodiment of the present invention for use in connection with what are referred to herein as 100 millimeter photomasks. 100 mm photomasks are similar to the reticles described in connection with the previously discussed embodiment, however, a 100 mm photomask contains a full wafer image. The pellicle configuration for a 100 mm photomask is generally circular with two diametrically opposing "flats". 100 mm photomask 62 with pellicle 64 attached thereto is shown in FIGS. 5 and 6 inserted in pellicle remover 60.

Housing 66 of pellicle remover 60 is a generally box-like structure having a shallow well 68 into which photomask 62 is placed. Photomask 62 rests on surface 70. Well 68 is of sufficient depth that photomask 62 is entirely below top surface 72 of housing 66 when resting on surface 70. Photomask 62 is placed in well 68 with pellicle 64 facing down.

Arm 74 is disposed within housing 66 and is mounted on shaft 76 such that arm 74 may rotate in a generally horizontal plane. Shaft 76 is supported within housing 66 by bearings 78 and 80. Bevel gear 82 is mounted on shaft 76 below bearing 78. Bevel gear 82 mates with bevel gear 84 on axle 86, which is perpendicular to shaft 76. Handle 88 is mounted to axle 86 outside of housing 66. Rotation of handle 88, such as by an operator, is communicated to arm 74. It will be appreciated that counterclockwise rotation of handle 88 as viewed in FIG. 6 will cause counterclockwise rotation of arm 74 as viewed in FIG. 5.

Blades 90 are mounted at either end of arm 74. Blades 90 are essentially the same as blades 24 described in connection with the previous embodiment. Blades 90 are secured to arm 74 by means such as screws 92. In a manner similar to that previously discussed in connection with blades 24, blades 90 are adjusted such that knife edges 94 are approximately 0.005–0.007 inches below surface 70 upon which photomask 62 rests. As in the previously discussed embodiment, this clearance assures that knife edges 94 will intercept the adhesive joining parallel 64 to photomask 62 during the pellicle removal operation.

Safety cover 96 is secured to housing 66 by means of hinge 98. Safety cover 96 is closed during the pellicle removal operation to protect the operator in the event that photomask 62 shatters.

Pellicle removal using device 60 is performed in the following manner. Handle 88 is first rotated to align arm 74 with one of the sides of housing 66. Photomask 62 is then placed in well 68 such that flats 65 of pellicle 64 are aligned with arm 74. Safety cover 96 is then closed. Handle 88 is next rotated in a counterclockwise direction as viewed in FIG. 6, causing arm 74 and blades 90 to rotate in a counterclockwise direction as viewed in FIG. 5. Knife edges 94 intercept the adhesive joining pellicle 64 to photomask 62 at approximately points 100. Rotation of handle 88 is continued until arm 74 makes one-half of a complete revolution. This is generally sufficient to separate pellicle 64 entirely from photomask 62. However, in some instances, pellicle 64 may remain attached to photomask 62 by adhesive underlying flats 65. In such cases, pellicles 64 may be easily removed by hand. Any adhesive remaining on photomask 62 may be removed by a suitable solvent such as MEK or acetone, or in an acid bath.

It will be recognized that the above described invention may be embodied in other specific forms without departing from the spirit or essential characteristics of the disclosure. Thus, it is understood that the invention is not to be limited by the foregoing illustrative details except as set forth in the appended claims.

I claim:

1. An apparatus for removing a pellicle of the type having a perimeter frame bonded to a first surface of a photomask with a layer of adhesive, said apparatus comprising:

a housing having a generally planar upper surface for supporting the first surface of the photomask, said upper surface including an aperture to accommodate the pellicle when the photomask is placed on said upper surface;

stop means disposed on said upper surface for preventing lateral and longitudinal displacement of the photomask on said upper surface;

a carriage moveable within said housing in a plane parallel to said upper surface;

a blade adjustably mounted on said carriage having a cutting edge generally parallel to said upper surface, said blade selectively positionable on said carriage so that said cutting edge is rigidly positioned immediately below said upper surface of said housing so as to intercept the layer of adhesive between the first surface of the photomask and the frame of the pellicle; and drive means for moving said carriage so that said blade is translated parallel to said upper surface along a path between the photomask and a portion of the perimeter frame of the pellicle.

2. The apparatus of claim 1 wherein said stop means comprises a shallow well to accommodate the photomask.

3. The apparatus of claim 1 wherein said path of said blade is linear.

4. The apparatus of claim 3 wherein said carriage moves linearly within said housing and said drive means comprises a rack attached to said carriage; a pinion mating with said rack; an axle having a first and a second end, said axle mounted in said housing for rotational motion therein, said pinion attached to said first end of said axle; and a handle attached to said second end of said axle.

5. The apparatus of claim 1 wherein said path of said blade is semi-circular.

6. The apparatus of claim 5 wherein said carriage rotates within said housing and said drive means comprises a first bevel gear attached to said carriage; a second bevel gear mating with said first bevel gear; and axle having a first and a second end, said axle mounted in said housing for rotational motion therein, said second bevel gear attached to said first end of said axle; and a handle attached to said second end of said axle.

7. An apparatus for removing a pellicle of the type having a generally rectangular frame bonded to a first surface of a photomask with a layer of adhesive, said rectangular frame including two long sides, said apparatus comprising:

a housing having a generally planar upper surface for supporting the first surface of the photomask, said upper surface including an aperture to accommodate the pellicle when the photomask is placed on said upper surface;

stop means disposed on said upper surface for preventing lateral and longitudinal displacement of the photomask on said upper surface;

a carriage longitudinally moveable within said housing in a direction parallel to said upper surface;

a blade adjustably mounted on said carriage having a cutting edge generally parallel to said upper surface, said blade selectively positionable on said carriage so that said cutting edge is rigidly positioned immediately below said upper surface of said housing so as to intercept the layer of adhesive between the first surface of the photomask and the frame of the pellicle;

drive means for moving said carriage so that said blade is translated parallel to said upper surface along a path between the photomask and one of the long sides of the pellicle frame.

8. An apparatus for removing a pellicle of the first type having a generally circular frame bonded to a first surface of a photomask with a layer of adhesive, said generally circular frame having two diametrically opposing curved sides joined by two flats, said apparatus comprising:

a housing having a generally planar upper surface for supporting the first surface of the photomask, said upper surface including an aperture to accommodate the pellicle when the photomask is placed on said upper surface;

stop means disposed on said upper surface for preventing lateral and longitudinal displacement of the photomask on said upper surface;

a carriage rotatable within said housing in a plane parallel to said upper surface;

a blade adjustably mounted on said carriage having a cutting edge generally parallel to said upper surface, said blade selectively positionable on said carriage so that said cutting edge is rigidly positioned immediately below said upper surface of said housing so as to intercept the layer of adhesive between the first surface of the photomask and the frame of the pellicle;

drive means for rotating said carriage so that said blade is translated parallel to said upper surface along a semi-circular path between the photomask and one of the curved sides of the pellicle frame.

9. A method for removing a pellicle of the type having a perimeter frame bonded to a first surface of a photomask with a layer of adhesive comprising the steps of:

(a) placing the photomask in a housing with the first surface of the photomask supported by an upper surface of said housing;

(b) securing the photomask in said housing so as to prevent lateral and longitudinal displacement of said photomask;

(c) positioning a blade rigidly in a movable carriage of said housing so that a cutting edge of said blade is positioned immediately below said upper surface of said housing so as to intercept the layer of adhesive between the perimeter frame and the first surface of the photomask; and (d) moving said blade in a controlled manner such that said cutting edge is translated parallel to said upper surface along a path between the photomask and a portion of the perimeter frame of the pellicle;

whereby said pellicle is separated from said photomask.

* * * * *

UNITED STATES PATENT AND TRADEMARK OFFICE

CERTIFICATE OF CORRECTION

PATENT NO. : 4,898,058

DATED : 2/6/90

INVENTOR(S) : Seifert

It is certified that error in the above-identified patent and that said Letters Patent is hereby corrected as shown below:

| | | |
|---|---|---|
| col. 01, line 46 | delete "lamp" | insert --image-- |
| col. 04, line 33 | delete "parallel" | insert --pellicle-- |

Signed and Sealed this

Twentieth Day of August, 1991

*Attest:*

*Attesting Officer*

HARRY F. MANBECK, JR.

*Commissioner of Patents and Trademarks*